United States Patent [19]

Neff

[11] Patent Number: 4,575,933

[45] Date of Patent: Mar. 18, 1986

[54] APPARATUS FOR PLACING OR MOUNTING RING TRAVELERS ON SPINNING OR TWISTING RINGS

[75] Inventor: Andreas Neff, Pfäffikon, Switzerland

[73] Assignee: Bräcker AG, Pfäffikon, Switzerland

[21] Appl. No.: 656,674

[22] Filed: Oct. 1, 1984

[30] Foreign Application Priority Data

Oct. 5, 1983 [CH] Switzerland ..... 5421/83

[51] Int. Cl.[4] ..... B23P 19/04

[52] U.S. Cl. ..... 29/765; 29/229

[58] Field of Search ..... 29/229, 241, 235, 765

[56] References Cited

U.S. PATENT DOCUMENTS

| | | | |
|---|---|---|---|
| 2,856,676 | 10/1958 | Furst | 29/765 |
| 3,106,770 | 10/1963 | Grupp | 29/765 |
| 3,263,317 | 8/1966 | Iwamatsu | 29/765 |
| 3,490,127 | 1/1970 | Anderson | 29/765 |

FOREIGN PATENT DOCUMENTS 1128219 9/1968 United Kingdom .

*Primary Examiner*—Howard N. Goldberg

*Assistant Examiner*—Steven Nichols

*Attorney, Agent, or Firm*—Werner W. Kleeman

[57] ABSTRACT

Ring travelers supplied on a magazine strip are transferred to a magazine bar by pulling at the magazine strip in a predetermined direction. At its front end the magazine bar is bent-off at right angles and is tapered in order to form a hook at this location for placing a momentarily preparatory-held ring traveler onto the annular flange of a spinning or twisting ring. The preparatorily-held ring traveler is clamped between the hook and a separator element in a tongue-like manner. The separator element is connected to a housing structured as a handle by means of a pivotable support. To mount the ring traveler at the angular flange of the spinning or twisting ring the handle-like housing must be retracted, and during this retraction the magazine bar which is mounted at a slide is pulled out from the housing against the force of a spring. During the relative movement between the magazine bar and the separator element the latter separates the foremost ring traveler from the supply of ring travelers and pushes this ring traveler into a desired position at the hook. Such apparatus enables the ring to be single-handedly mounted in rapid sequence.

13 Claims, 5 Drawing Figures

APPARATUS FOR PLACING OR MOUNTING RING TRAVELERS ON SPINNING OR TWISTING RINGS

BACKGROUND OF THE INVENTION

The present invention relates to a new and improved apparatus for mounting ring travelers at a spinning or twisting ring.

In its more particular aspects, the present invention relates specifically to a new and improved apparatus for placing or mounting ring travelers on or at a spinning or twisting ring, comprising a housing structured as a handle and open at least at one end face thereof. A magazine bar is arranged in the housing and serves to receive the ring travelers. An end of the magazine bar adjacent the open end face of the housing is bent-off and tapered. A stop is connected to the magazine bar and can be displaced out of the travel path of the ring travelers. A separator element comprises a separating edge and forwardly displaces the momentarily foremost ring traveler from a supply of ring travelers while overcoming the stop.

An apparatus of such type as known, for example, from German Patent Publication No. 1,510,876 comprises as the separator element a wedge-shaped member which is mounted at a plate spring and which can be manually depressed in the direction towards the magazine bar. The wedge of the wedge-shaped member forwardly displaces the foremost ring traveler from the supply of ring travelers. Thereafter, the forwardly displaced ring traveler slides on the magazine bar, which is held at a downwardly directed inclination, and over the bent-off end thereof onto the spinning or twisting ring at which the apparatus must be supported with its bent-off end prior to this operation. During this operation the ear-shaped ring traveler is suspended with one bracket section or curved portion thereof at the flange of the spinning or twisting ring. The operator is then required, by using his finger, to snap the ring traveler with the other bracket section or curved portion thereof onto the spinning or twisting ring.

In the construction as explained hereinbefore the known apparatus is only suited for placing vertically travelling, ear-shaped ring travelers on flanged rings. Its greatest disadvantage, however, resides in the fact that both hands are required for mounting the ring travelers. During this operation the apparatus must be held by one hand, such as the left hand while the ring traveler has to be pressed using the index finger of the other, in this case the right hand. It can be considered a further disadvantage that the ring traveler which has been separated by downwardly pressing the wedge-shaped member, slides off from the magazine bar and drops down when the apparatus has not yet been correctly placed at the ring.

Further, more or less complicated methods and apparatus for mounting ring travelers at spinning or twisting rings can be assumed to be sufficiently known in the art. From the multifariousness of such methods and apparatus it can be recognized that despite extensive efforts up to the present time there has not been found any satisfactory solution to this problem.

SUMMARY OF THE INVENTION

Therefore, with the foregoing in mind, it is a primary object of the present invention to provide a new and improved apparatus for placing ring travelers onto a spinning or twisting ring and which is constructed in a manner not afflicted with the aforementioned drawbacks and limitations of the prior art heretofore discussed.

Another and more specific object of the present invention is directed to the provision of a new and improved apparatus for placing or mounting ring travelers on a spinning or twisting ring and which, in spite of its simple structure, enables single-handed placement of the ring travelers.

Now, in order to implement these and still further objects of the invention, which will become more readily apparent as the description proceeds, the apparatus of the present development is manifested by the features that, the end of the magazine bar is bent-off in a hook-like manner, the separator element and the magazine bar are displaceable relative to each other at least in a lengthwise direction between an inoperative position and an operative position, and the separator element comprises a clamping jaw which coacts in one of these two positions with the longitudinal side of the hook-like end of the magazine bar in order to temporarily and fixedly clamp the ring traveller at one curved portion thereof and which ring traveler has been forwardly displaced from the supply of ring travelers.

The placement of the ring traveler at the spinning or twisting ring succeeds in a single-handed operation because the ring traveler is fixedly clamped with one curved portion thereof at the end of the magazine bar which is bent-off in a hook-like manner. It is then sufficient to engage the free curved portion of the ring traveler at the internally located margin of the flange of the ring and to enlarge the ring traveler by pulling at the handle of the apparatus to such an extent that the other curved portion thereof snaps onto the externally located margin of the flange of the ring. Thereafter the hook-like end of the magazine bar must be pulled out from the ring traveler. In order to avoid that the thread or the like which is to be spun or twisted has to be threaded later and in a relatively complicated manner into the ring traveler already placed or mounted in position, the thread can be caught by the ring traveler fixedly clamped to the apparatus and prior to the mounting of the ring traveler without losing the ring traveler during this operation.

Although the inventive apparatus is destined substantially for use with C-shaped ring travelers, it is also suited for use with differently structured ring travelers according to the same principle.

In order to effect the relative displacement the magazine bar can be fixedly connected to the housing, whereas the separator element can be displaced. Instead, the separator element can be connected to the housing, whereas the magazine bar can be displaced. According to a preferred embodiment the separator element is coupled to the housing and conjointly displaceable therewith relative to the magazine bar. In such embodiment the relative displacement is thus accomplished by retracting the housing which is structured like a handle while the ring traveler is enlarged for mounting the same by means of the hook-like end of the magazine bar. Since the separator element is also entrained by pulling at the housing, the separator element will already forwardly displace the next following ring traveler during the return movement in order to keep the same ready for the consecutive placement or mounting operation. Such an embodiment, therefore, enables a particularly rational mode of operation.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figures 1, 2, 3, 4, 5:
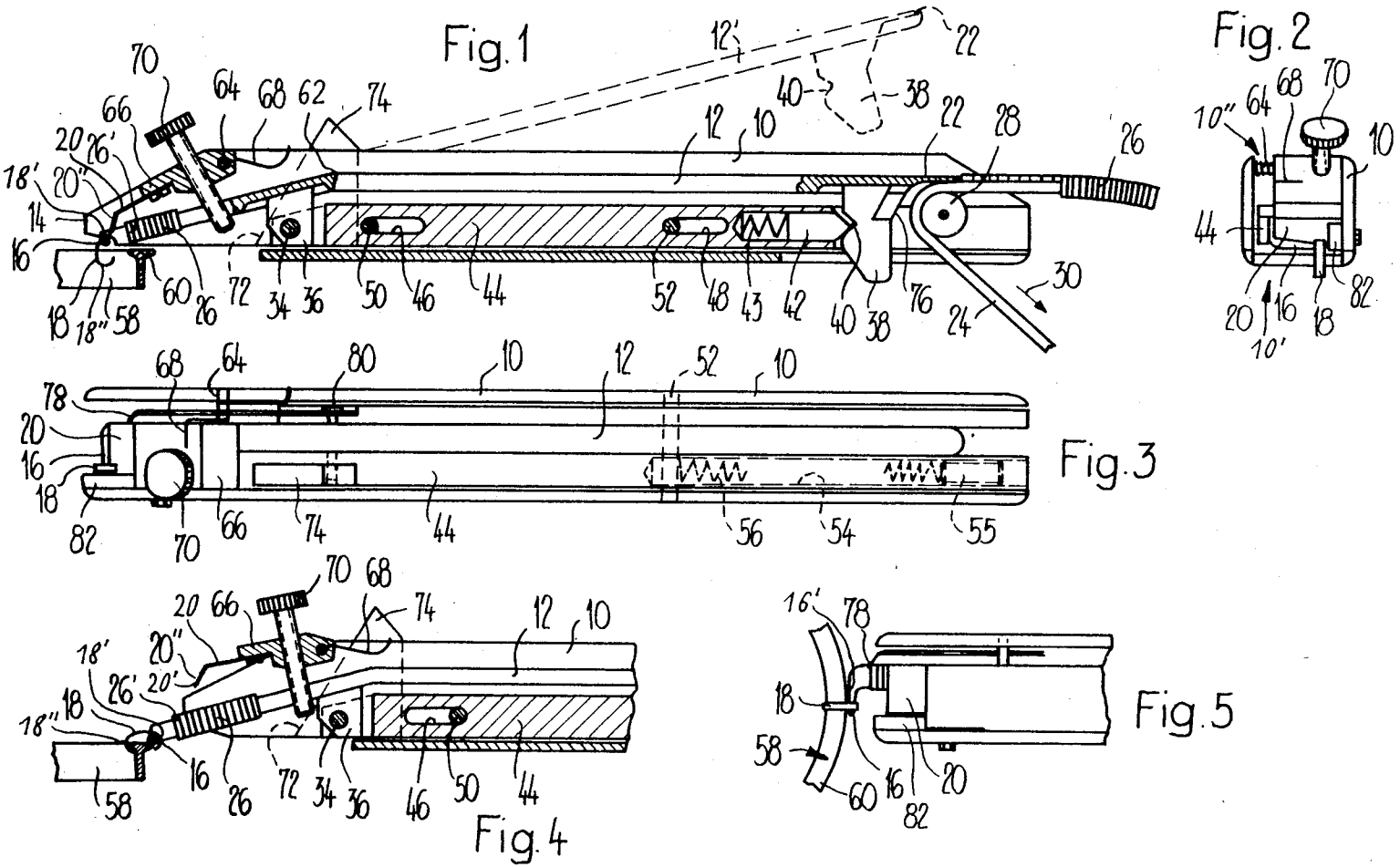
FIG. 1 shows a longitudinal section through an apparatus according to the invention for placing or mounting ring travelers on a spinning or twisting ring and shows the inoperative position thereof including a ring traveler which is kept ready for placement or mounting.
FIG. 2 is an end view of the apparatus shown in FIG. 1.
FIG. 3 is a top plan view of the apparatus shown in FIG. 1.
FIG. 4 is a partial view in longitudinal section of the apparatus shown in FIG. 1 in the operative position thereof.
FIG. 5 is a top plan view of the head side of the apparatus shown in FIG. 4 in the operative position.

Describing now the drawings, it is to be understood that only enough of the construction of the apparatus has been shown as needed for those skilled in the art to readily understand the underlying principles and concepts of the present development, while simplifying the showing of the drawings. Turning attention now specifically to FIG. 1, there has been illustrated in longitudinal section a ring traveler mounting apparatus comprising a housing 10 which is structured as a handle and forms a U-shaped profile 10' (see FIG. 2) in cross-section. A magazine bar 12 is displaceably mounted in the housing 10 substantially in lengthwise direction. At both its end faces the housing 10 is open. Adjacent the front end face 14 of the housing 10 the magazine bar 12 is sharply downwardly bent at a sharp bend in the region of its end face and comprises a rectangularly bent-off and tapered end 16 having a longitudinal side 16' (see FIG. 5). A ring traveler 18 is fixedly clamped to this hook-like end 16 at one curved portion or bracket section of the ring traveler by means of a separator element 20 having a separating edge 20' and defining a clamping jaw 20''.

Ring travelers 26 are lined up on a magazine strip 24 and are supplied to the magazine bar 12 at its rear end 22. In order to faultlessly transfer the ring travelers 26 from the magazine strip 24, the magazine bar 12 comprises at its rear end 22 a lengthwise groove. In its remaining region the magazine bar 12 is adapted to the profile of the internal shape of the ring travelers 26. The empty magazine strip 24 is wound around a deflection roll 28 and manually pulled in the direction of the arrow 30 in order to further supply the ring travelers 26. A not particularly illustrated knife or cutting device may be arranged in the housing 10 and has a downwardly directed cutting edge for cutting off the end of the not further required magazine strip 24.

In order to facilitate the comprehensibility of the drawings only part of the ring travelers 26 is shown in the illustrated embodiment. During practical use of the apparatus, ring travelers 26 are lined up and form a supply of ring travelers along the entire length of the magazine bar 12 up to the foremost ring traveler 26'. The magazine strip 24 occupied by the ring travelers 26 can be withdrawn from a larger supply which the operator, for example, can wear in his pocket. In order to connect the starting end of the supply of ring travelers 26 to be supplied in a simple manner with the apparatus or in order to slide thereupon plastic-coated travelers, the magazine bar 12 can be outwardly pivoted about a pivot shaft or axis 34 into the position 12'.

In the region of its two ends the magazine bar 12 comprises related radially arranged lugs 36, 38. The front lug 36 is pivotable about the pivot shaft or axis 34 in order to outwardly flip or rock the magazine bar 12. The rear lug 38 comprises a locking notch 40 by means of which the magazine bar 12 is held in the inwardly pivoted position by means of a cam or dog 42 which is loaded by a spring 43. The cam 42 is secured from falling out by not particularly illustrated suitable securing means in order to prevent that the spring 43 urges the cam 42 towards the outside when the magazine bar 12 including its lug 38 is outwardly pivoted for recharging into the position 12' through an open side 10'' of the U-shaped profile 10' defined by the housing 10.

By means of the two lugs 36 and 38 the magazine bar 12 is connected to a slide 44 which comprises two series-arranged oblong holes 46 and 48 which are engaged by related pins 50 and 52 fixed at the housing 10 in order to guide the slide 44 in the housing 10 along a rectilinear path of movement.

According to FIG. 3 the slide 44 comprises a lengthwise bore 54 into which a compression spring 56 is inserted which is supported with one end thereof at the pin 52 which is fixed to the housing 10 with its other end and at an adjustment screw 55 which is threaded into the lengthwise bore 54.

The rectangularly bent-off and tapered end 16 of the magazine bar 12 serves as a hook at the longitudinal side 16' of which the C-shaped ring traveler 18 is fixedly clamped with one curved portion or bracket section 18' thereof in the illustrated embodiment. In order to place the ring traveler 18 at a spinning ring 58, see FIG. 1, the ring traveler 18 must be engaged with its free curved portion 18'' at the internally located margin of the annular flange 60 and then has to be snapped with its one curved portion 18' at the externally located margin of the annular flange 60 using the hook 16 and by pulling at the handle formed by the housing 10. The thread or yarn or the like which has been previously caught by the ring traveler 18 is not shown in the drawings.

During the pulling displacement exerted on the handle formed by the housing 10, the magazine bar 12 is withdrawn from this handle formed by the housing 10 against the force of the compression spring 56 as will also be evident from FIG. 4 still to be described later. The magazine bar 12 has a sharp angle 62 adjacent the front lug 36 and between the two lugs 36 and 38, due to the angle 62 the front region of the magazine bar 12 is downwardly inclined.

In the present embodiment the separator element 20 has a dual function by serving, on the one hand, to separate the foremost ring traveler 26' from the supply of ring travelers 26 and to forwardly displace the same while overcoming a still to be described displaceable stop. For this purpose the separator element 20 comprises at one end thereof a separating edge 20' which extends transversely to the axis of the magazine bar 12.

The separator element 20, on the other hand, has the function of and forms a clamping jaw 20″ which coacts with the rectangularly bent-off and tapered end 16 of the magazine bar 12 in order to temporarily retain the forwardly displaced ring traveler 18 at the one curved portion 18′ thereof. However, it is also possible to associate the clamping jaw 20″ as a separate element with the separator element 20.

The separator element 20 is coupled to the housing 10 and displaceable conjointly therewith relative to the magazine bar 12 by being mounted at a support 66 which is pivotable about a pin 64 fixed with respect to the housing 10. The separator element 20 is biased in the direction of the magazine bar 12 by the force of a torsion spring 68. An adjustment screw 70 is inserted into the support 66 and the lower end thereof coacts with an inclined end face 72 of a lug 74 when the slide 44 is displaced relative to the housing 10 against the force of the compression spring 56. The support 66, the adjustment screw 70, and the inclined end face 72 thus constitute means which are arranged between the separator element 20 and the magazine bar 12 and which control the distance therebetween during their relative displacement such that the separator element 20 lifts off from the magazine bar 12 when withdrawn therefrom and is seated back thereupon when forwardly displaced for separating the foremost ring traveler 18.

The lug 74 which is connected to the slide 44 protrudes from the housing 10 at the top and serves to displace the slide 44 conjointly with the magazine bar 12 relative to the housing 10 in order to bring the first ring traveler into its placement or mounting position at which the ring traveler 18 is located in the illustrated embodiment, when the apparatus is place into operation.

Instead of supplying the ring travelers 26 lined up on a strip 24, it is also possible to supply the ring travelers to the apparatus while the ring travelers are delivered in a plastic tube. In this case the ring travelers are also supplied at the rear end 22 of the magazine bar 12. A knife or cutting implement 76 is connected to the magazine bar 12 in order to cut open the plastic tube.

It will be evident from the end view of the apparatus shown in FIG. 2 that the housing 10 is substantially U-shaped in cross-section. The elements recognizable in FIG. 2 have already been explained hereinbefore with reference to FIG. 1.

In FIG. 3 a top plan view of the apparatus is shown and there is recognizable, in addition to the hitherto described elements, a stop comprising a plate spring 78 which serves as a stop for the foremost ring traveler 26′ and which is mounted at the slide or slide member 44 by means of a bolt 80. This plate spring 78, defining the stop, is displaceable out of the traveling path of the ring travelers and holds back the ring travelers 26 which are lined up along the magazine bar 12, see FIG. 1. This stop 78, however, can be overrun by the ring travelers 26 when the foremost ring traveler 26′ is forwardly displaced by the separator element 20. Adjacent an end face of the hook-shaped end 16 of the magazine bar 12 there is arranged a lateral abutment 82 which is fixed relative to the housing 10 and which prevents the forwardly displaced ring traveler from dropping down.

FIG. 4 shows the apparatus in its operative position in which the magazine bar 12 is pulled out or the handle formed by the housing 10 is retracted. In this position the bent-off end 16 of the magazine bar 12 is still in engagement with the ring traveler 18 which is placed onto the annular flange 60 of the ring 58. The clamping jaw 20″ of the separator element 20 which previously coacted with the bent-off end 16, has already released the ring traveler 18. It will be evident from the associated FIG. 5 that, due to the relative displacement between the housing 10 and the hook-shaped end 16 of the magazine bar 12, the mounted ring traveler 18 has also been released from the abutment 82 fixed to the housing 10. It will be further recognized from FIG. 5 that the ring traveler 18 placed or mounted on the annular flange 60 is released by lateral displacement of the apparatus. The placement or mounting operation is terminated thereby.

It is further evident from FIG. 4 that, during the placement or mounting operation and while the magazine bar 12 is pulled out from the housing 10, the slide 44 which is connected to the magazine bar 12, is displaced in such a manner that the inclined end face 72 coacts with the lower end of the adjustment screw 70, so that the support 66 conjointly with the separator element 20 is clockwisely pivoted about the pin 64, whereby the separator element 20 is lifted off from the magazine bar 12. When released, the slide 44 and the magazine bar 12 are moved back again under the action of the compression spring 56 which constitutes a return spring and during this movement the inclined end face or abutment surface 72 is retracted again from the adjustment screw 70 and the separator element 20 is lowered again onto the magazine bar 12 under the action of the torsion spring 68. By appropriately adjusting the adjustment screw 70 it can now be accomplished that the separator element 20, when it is lowered, encounters the gap between the foremost ring traveler 26′ and the successive or next following ring traveler in order to ensure that only the foremost ring traveler 26′ is displaced to the end 16 of the magazine bar 12 and overcomes the stop 78 during the further relative displacement between the housing 10 and the magazine bar 12.

The magazine bar 12 is adapted in its cross-section to the internal shape of the ring travelers 26. At the rear end 22 the magazine bar 12 is provided with a downwardly open longitudinal groove, so that there is space in the groove for the magazine strip 24 in the transfer region of the ring travelers 26.

Using the illustrated apparatus the ring travelers 26 can be mounted onto the spinning or twisting rings 58 in rapid sequence. Except for the pulling displacements exerted on the handle formed by the housing 10 of the apparatus there are no further elements of the apparatus which have to be actuated for the traveler mounting operation. After termination of the mounting operation the apparatus automatically ensures that the next-following ring traveler is guided into the stand-by or preparatory position for mounting and is non-detachably fixedly clamped. A large number of ring travelers can be mounted without the requirement of any specific means or expenses for reloading, when ring travelers are used which are supplied on a magazine strip 24. It is merely sufficient to pull at the free end of the magazine strip from time to time in order to transfer the ring travelers 26 from the magazine strip 24 to the magazine bar 12.

While there are shown and described present preferred embodimments of the invention, it is to be distinctly understood that the invention is not limited thereto, but may be otherwise variously embodied and practiced within the scope of the following claims. Accordingly,

What I claim is:

1. An apparatus for mounting ring travelers on a spinning or twisting ring, comprising:

a housing structured as a handle and defining at least one open end face;

a magazine bar arranged in said housing and serving to receive a supply of the ring travelers;

said magazine bar defining an end adjacent said at said at least one open end face of said housing;

said end of said magazine bar being tapered and being bent-off in the manner of a hook;

a stop connected to said magazine bar and outwardly displaceable out of a traveling path of said ring travelers;

a separator element comprising a separating edge and serving for forwardly displacing a foremost ring traveler of said supply of ring travelers while overcoming said stop connected to said magazine bar;

said magazine bar and said separator element being displaceable relative to each other at least in lengthwise direction between an inoperative position and an operative position;

said end of said magazine bar, which is bent-off in the manner of a hook, defining a longitudinal side; and said separator element comprising a clamping jaw which coacts with said longitudinal side of said end of said magazine bar in order to temporarily and fixedly clamp said foremost ring traveler, which is forwardly displaced from said supply of ring travelers, at one curved portion thereof.

2. The apparatus as defined in claim 1, further including:

a return spring for returning at least one of said separator element and said magazine bar which are relatively movably from operative position into its inoperative position.

3. The apparatus as defined in claim 1, wherein:

said separator element is coupled to said housing; and said separator element being conjointly displaceable with said housing relative to said magazine bar.

4. The apparatus as defined in claim 3, further including:

means arranged between said separator element and said magazine bar in order to control the distance between said separator element and said magazine bar, during the relative displacement thereof in lengthwise direction, in such a manner that said separator element, during its withdrawal from said magazine bar, lifts off from said magazine bar and is seated back thereupon during the relative forward displacement between the foremost and a successive one of said ring travelers.

5. The apparatus as defined in claim 1, further including:

a lateral abutment provided at said housing and placed immediately opposite an end face of said end of the magazine bar bent-off in the manner of a hook.

6. The apparatus as defined in claim 1, further including:

a slide guided in said housing;

a predetermined number of lugs radially arranged at said magazine bar; and said magazine bar being connected to said slide by; means of said lugs.

7. The apparatus as defined in claim 6, further including:

a predetermined number of pins which are fixedly positioned at said housing;

a predetermined number of oblong holes provided in said slide; and said pins at said housing engaging related ones of said oblong holes in said slide in order to guide said slide along a substantially rectilinear path of travel.

8. The apparatus as defined in claim 1, wherein:

said magazine bar is downwardly bent in the region of its end face by means of a sharp bend.

9. The apparatus as defined in claim 1, wherein:

said housing is formed with a substantially U-shaped profile defining an open side of the housing; and said magazine bar being outwardly pivotable through said open side of said housing for the purpose of re-loading with ring travelers.

10. The apparatus as defined in claim 1, wherein:

said inoperative position is defined as a position in which said foremost ring traveler in the forwardly displaced position thereof is fixedly clamped to said end of said magazine bar which is bent-off in the manner of a hook.

11. The apparatus as defined in claim 1, further including:

a spring acting upon said separator element in order to bias the same in the direction of said magazine bar.

12. The apparatus as defined in claim 11, wherein:

said spring biases said separator element in the direction of said end of the magazine bar which is bent-off in the manner of a hook.

13. The apparatus as defined in claim 1, further including:

a plate spring engaging said magazine bar from the outside and defining said stop which is outwardly displaceable from the traveling path of the ring travelers.

* * * * *

UNITED STATES PATENT AND TRADEMARK OFFICE

CERTIFICATE OF CORRECTION

PATENT NO. : 4,575,933

DATED : March 18, 1986

INVENTOR(S) : ANDREAS NEFF

It is certified that error appears in the above—identified patent and that said Letters Patent is hereby corrected as shown below: Title page:

IN THE "ABSTRACT", line 21 (bottom line), after "ring" insert --travelers--

Column 5, line 34, before "into" delete "place" and insert --placed--

Column 8, line 12, after "by" delete ";"

Signed and Sealed this

*First* Day of *July 1986*

[SEAL]

*Attest:*

DONALD J. QUIGG

*Attesting Officer*

*Commissioner of Patents and Trademarks*